US008429894B2

(12) United States Patent
Cap et al.

(10) Patent No.: US 8,429,894 B2
(45) Date of Patent: Apr. 30, 2013

(54) NANO-GRAINED ALUMINUM ALLOY BELLOWS

(75) Inventors: Daniel P. Cap, Chatsworth, CA (US); Ronald Urquidi, Van Nuys, CA (US); Guido Canzona, Burbank, CA (US)

(73) Assignee: Pratt & Whitney Rocketdyne, Inc., Canoga Park, CA (US)

( * ) Notice: Subject to any disclaimer, the term of this patent is extended or adjusted under 35 U.S.C. 154(b) by 634 days.

(21) Appl. No.: 12/234,851

(22) Filed: Sep. 22, 2008

(65) Prior Publication Data

US 2010/0075171 A1 Mar. 25, 2010

(51) Int. Cl.
*F02K 9/48* (2006.01)

(52) U.S. Cl.
USPC ..... 60/257; 60/799; 60/909

(58) Field of Classification Search ..... 60/257, 60/259, 799, 909
See application file for complete search history.

(56) References Cited

U.S. PATENT DOCUMENTS

| | | | | |
|---|---|---|---|---|
| 3,090,198 | A * | 5/1963 | Zeisloft | 239/265.35 |
| 4,647,321 | A | 3/1987 | Adam | |
| 4,741,502 | A * | 5/1988 | Rosen | 244/158.9 |
| 4,792,161 | A * | 12/1988 | Usui | 285/45 |
| 4,818,481 | A | 4/1989 | Luton | |
| 4,889,582 | A | 12/1989 | Simon | |
| 5,143,409 | A * | 9/1992 | Lalikos | 285/116 |
| 5,145,215 | A * | 9/1992 | Udell | 285/49 |
| 5,147,446 | A * | 9/1992 | Pechenik et al. | 75/230 |
| 5,437,479 | A * | 8/1995 | Hartling et al. | 285/49 |
| 5,806,899 | A * | 9/1998 | Norikawa et al. | 285/299 |
| 5,842,723 | A * | 12/1998 | Hartling et al. | 285/49 |
| 5,849,373 | A | 12/1998 | Barbour | |
| 6,248,453 | B1 | 6/2001 | Watson | |
| 6,260,375 | B1 * | 7/2001 | Kuo | 62/407 |
| 6,282,887 | B1 * | 9/2001 | Polushin et al. | 60/257 |
| 6,312,643 | B1 * | 11/2001 | Upadhya et al. | 419/33 |
| 6,723,387 | B1 * | 4/2004 | Kear et al. | 427/450 |
| 6,848,163 | B2 * | 2/2005 | Bampton et al. | 29/508 |
| 6,902,699 | B2 * | 6/2005 | Fritzemeier et al. | 419/38 |
| 7,187,106 | B2 * | 3/2007 | Fuse et al. | 310/328 |
| 7,207,922 | B2 * | 4/2007 | Kuhstrebe et al. | 477/97 |
| 7,354,490 | B2 | 4/2008 | Fritzemeier | |
| 2006/0198754 | A1 | 9/2006 | Bampton | |
| 2009/0186238 | A1 * | 7/2009 | Bampton | 428/650 |

FOREIGN PATENT DOCUMENTS

| | | |
|---|---|---|
| EP | 1788102 | 5/2007 |

* cited by examiner

*Primary Examiner* — Ehud Gartenberg
*Assistant Examiner* — Vikansha Dwivedi
(74) *Attorney, Agent, or Firm* — Carlson, Gaskey & Olds

(57) ABSTRACT

A bellows includes a flexible section including a series of convolutions extending between a first end and a second end. The convolutions are formed of a nano-grained aluminum alloy.

7 Claims, 2 Drawing Sheets

NANO-GRAINED ALUMINUM ALLOY BELLOWS

BACKGROUND OF THE INVENTION

This disclosure relates to flexible bellows and, more particularly, to a bellows having a convoluted section formed of a nano-grained aluminum alloy.

A typical duct for conveying a fluid from one location to another may include a bellows to facilitate routing the duct around other components or to absorb relative movement between the two locations. Typically, the bellows is formed from a material that is suitable for handling the fluid and withstanding temperatures, pressures, or other operating conditions of the duct. However, in some instances, the complexity of the shape of the bellows may limit selection of the material based on processability of the material. For instance, a nickel alloy may be formed into relatively complex shapes, but conventional precipitation strengthened aluminum alloys require special metallurgical processing to regain strength during and after forming processes, which limits it use for certain specific shapes, such as a bellows.

SUMMARY OF THE INVENTION

An example bellows comprises a flexible section having a number of convolutions extending from end to end. The flexible, convoluted section is formed of a nano-grained aluminum alloy.

In one example, the bellows is used in an engine system that includes a fuel tank, an engine, and the duct incorporating a bellows, connecting the fuel tank and the engine.

BRIEF DESCRIPTION OF THE DRAWINGS

The various features and advantages of the disclosed examples will become apparent from the following detailed description. The drawings that accompany the detailed description can be briefly described as follows.

DETAILED DESCRIPTION OF THE PREFERRED EMBODIMENT

Figure 1:
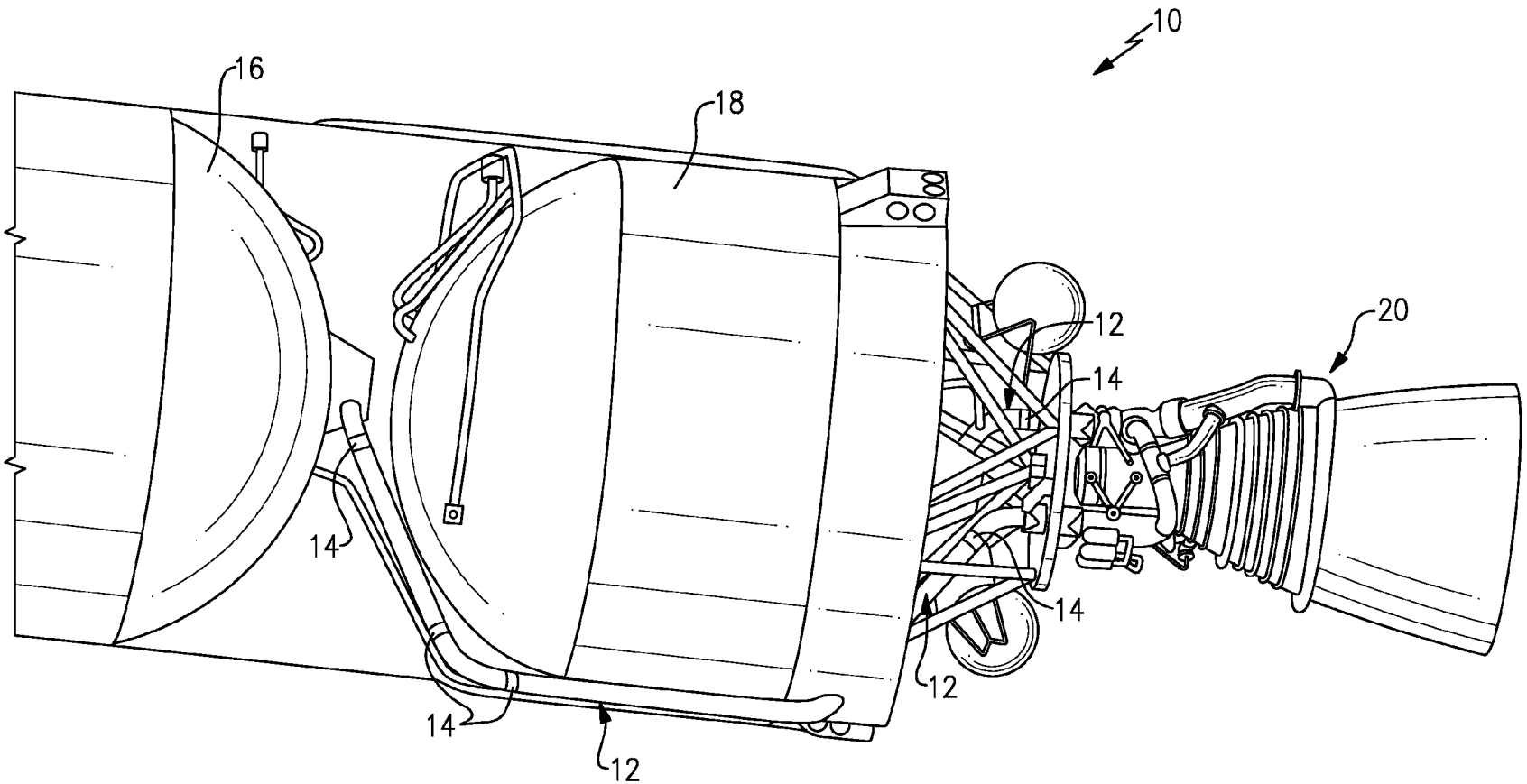
FIG. 1 illustrates an example vehicle utilizing a duct incorporating a bellows as a component of said duct.

FIG. 1 illustrates selected portions of an example vehicle 10 having a flexible duct 12 that includes one or more bellows 14. As may be appreciated, the number of flexible ducts 12 may vary from a single flexible duct 12 to multiple flexible ducts 12 depending on the design of the vehicle 10. In this example, the vehicle 10 is a rocket portion of a space vehicle; however, it is to be understood that the example bellows 14 and flexible ducts 12 may be used in other applications that would benefit therefrom, such as automobiles, machinery, aircraft, spacecraft, processing, industrial or refinery equipment, etc.

In this example, the vehicle 10 includes a first storage tank 16 and a second storage tank 18 that deliver fuel and oxidizer to a rocket engine 20. For example, pumps or other actuators may be used to facilitate delivery. In operation, the first storage tank 16, the second storage tank 18, and the rocket engine 20 may move relative to each other due to vibration, shock, deflections, thermal differences or other forces experienced by the vehicle 10. The relative movement may cause the bellows 14 to deflect axially, radially, or torsionally. In this regard, the bellows 14 are able to compress, bend, lengthen, and twist in response to the relative movement while maintaining the connection.

Figure 2:
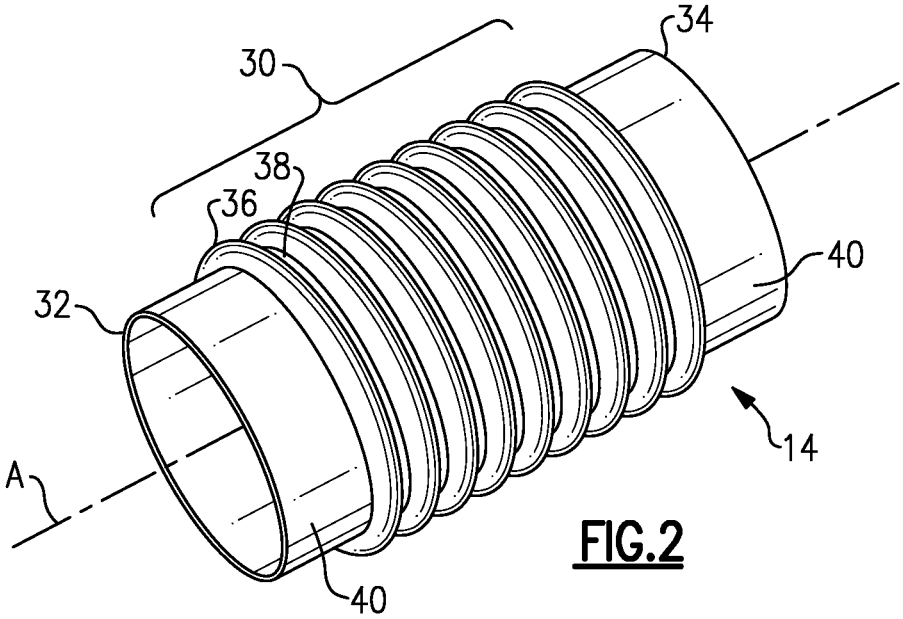
FIG. 2 illustrates an example of the nano-grained aluminum bellows.

FIG. 2 illustrates an example of one of the bellows 14. In this example, the bellows 14 includes a series of convolutions 30 that extend between a first end 32 and a second end 34. The convolutions 30 include alternating crowns 36 and roots 38 along an axis A of the bellows 14. A crown is that portion of the convolution that is farthest from the bellows centerline and a root is that portion of the convolution that is nearest to the bellows centerline and either or both can be of any size or shape. The alternating arrangement provides the bellows 14 with the ability to compress, twist, or bend about the axis A. It is understood that multiple bellows in the system or duct would improve the flexibility of the system.

Optionally, the bellows 14 includes one or more non-convoluted sections 40 extending from the convoluted section 30. In the disclosed example, the bellows 14 includes one of the non-convoluted sections 40 at each of the first end 32 and the second end 34. For example, the non-convoluted sections 40 may be used to attach the bellows 14 to a mating component in a known manner, such as another section of the bellows 14, the duct 12, the first storage tank 16, the second storage tank 18, the rocket engine 20, or other component as required or necessary to add flexibility to the system. In other examples, the non-convoluted section 40 may include a flange or other known attachment feature for connecting the bellows 14.

The bellows 14 is formed from a nano-grained aluminum alloy. For example, the term "nano-grained aluminum alloy" as used in this disclosure refers to a class of aluminum alloys that may be defined by composition, average grain size of the alloy, and/or the processing techniques used to form the nano-grained aluminum alloy. The composition, average grain size, and processing techniques are discussed in greater detail below.

For example, the nano-grained aluminum alloy may include a composition having at least about 0.3 wt % of nitrogen, about 88.7-98.7 atomic % of aluminum, and about 1-11 atomic % of magnesium, lithium, silicon, titanium, and zirconium. In some examples, the nitrogen may be present within the alloy in the form of aluminum nitride, magnesium nitride, lithium nitride, silicon nitride, titanium nitride, zirconium nitride, or combinations thereof. In a further example, the metal of the nano-grained aluminum alloy is magnesium in an amount of about 4-10 atomic %. In any of the above examples, the alloy may further include about 6-14 atomic % of one or more additional metals selected from zinc, copper, cobalt, zirconium, and nickel.

The term "about" as used in this description relative to compositions or other values, refers to possible variation in the given value, such as normally accepted variations or tolerances in the metallurgical process. Additionally, the disclosed compositions may include only the given elements and impurities that do not materially affect the properties (e.g., strength, processability, etc.) of the nano-grained aluminum alloy or impurities that are unmeasured or undetectable. In other examples, the disclosed compositions may include only the given elements and amounts.

In addition to or in place of composition, the nano-grained aluminum alloy may be defined by microstructural grain size. For example, the nano-grained aluminum alloy may include an average grain size of about 0.5 micrometers (19.7 micro-inches) or less as measured through commonly known techniques, such as scanning electron microscopy. For instance, the average grain size refers to the average diameter of the polycrystalline grains comprising the nano-grained aluminum alloy microstructure and does not refer to inclusions or intermetallic phases that may be present in some alloys. As may be appreciated, the average grain size of the nano-grained aluminum alloy may vary in size over the given range of about 0.5 micrometers or less, but may be limited by the processing techniques used to create the grain size or the composition of the nano-grained aluminum alloy.

Additionally, or in place of the composition or grain size, the nano-grained aluminum alloy may be defined by a processing technique used to form the nano-grained aluminum alloy. That is, the nano-grained aluminum alloy may be formed using methods other than traditional heat treatment methods. For example, the nano-grained aluminum alloy may be formed using a cryomilling process that includes milling particles of a stock aluminum alloy under cryogenic conditions in a nitrogen atmosphere.

The nano-grained aluminum alloy may be formed into the shape of the bellows 14 using a pressure-forming technique, but is not restricted to such technique for forming. For example, a powder comprising the nano-grained aluminum alloy may be extruded into a tubular shape that is then used to form the bellows 14. To form the convoluted section 30 from the tubular shape, the tubular shape may be constrained within a tool having a shape of the crowns 36 and roots 38. The tubular shape is then internally pressurized to expand the walls against the tool to form the crowns 36 and roots 38 of the convoluted section 30.

Optionally, the crowns 36 and roots 38 of the convoluted section 30 may be formed in stages. For instance, a portion of the crowns 36 and roots 38 may be formed in a first stage as described above and subsequently annealed at an elevated temperature to relieve work hardening of the nano-grained aluminum alloy and regain ductility. After the annealing, another portion or portions of the remainder of the crowns 36 and roots 38 may be formed in additional stages and the bellows 14 may be annealed again to relieve work hardening and regain ductility. Additional stages may be used, depending how many of the crowns 36 and roots 38 are formed in a single stage or varying stages and how many total crowns 36 and roots 38 the convoluted section 30 is to include.

Using the nano-grained aluminum alloy allows annealing in between forming stages, whereas conventional aluminum alloys that require quenching for precipitation hardening would present difficulties because the quenching and relatively high residual stresses will result in distortion of the original shape. Fine nitride phases from the prior cryomilling strengthen the nano-grained aluminum alloy. Thus, the nano-grained aluminum alloy can be readily formed into the relatively complex convoluted shape of the bellows 14.

Nano-grained aluminum has ultimate tensile strength comparable to titanium. Nano-grained aluminum has a density approximately one-third of INCONEL® nickel based superalloys. Therefore, nano-grained aluminum has outstanding strength to weight ratio. In addition, complex geometries are relatively simple to manufacture using conventional manufacturing processes. In contrast, complex geometries achieving a similar strength to weight ratio would be difficult with conventional manufacturing processes.

The bellows 14 manufactured of nano-grained aluminum has superior flexibility and reduced weight when compared with commonly used materials (titanium, nickel based alloys, stainless steel). Further, the bellows 14 is suitable as a structural element due to its strength and flexibility. The bellows 14 could also be used in a variety of other applications, such as suspension mechanisms, shock absorbers, vibration dampeners, and weight distribution. The bellows 14 could also be used in fluid distribution applications with flexibility needs, thereby reducing overall length (envelope reduction) and weight (overall lighter system). For example, the bellows 14 could substantially reduce the length and weight of a duct. In another example, the bellows 14 could be used in a positive fluid expulsion system, such as a fuel or oxidizer tank. The bellows 14 is therefore suited for a variety of different applications, such as sporting equipment, rocket engines, commercial trucking and transportation, and other performance oriented applications.

Figure 3:
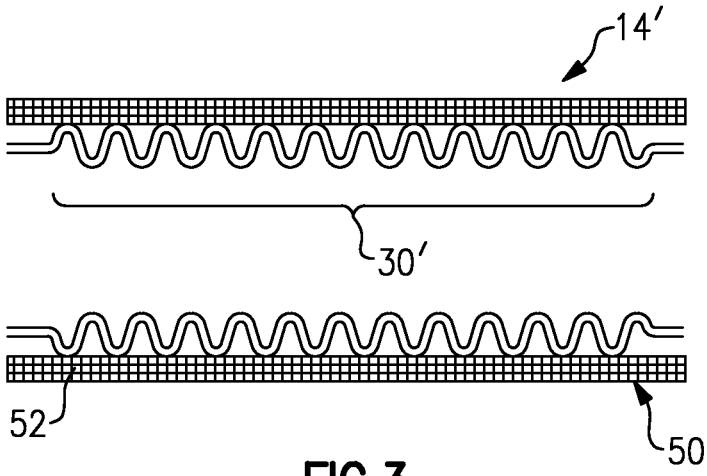
FIG. 3 illustrates an example of a flex hose incorporating a nano-grained aluminum bellows.

FIG. 3 illustrates a cross-section of another example bellows 14' that is similar to the bellows 14 shown in FIG. 2, but includes an overbraid 50 (e.g., sleeve) that extends about the convoluted section 30'. For example, the overbraid 50 includes metal wires 52 woven in a desired pattern. In one example, the metal wires 52 are braided.

In one example, a pressure of a fluid within the bellows 14' may tend to cause the convoluted section 30 to unfold. The overbraid 50 reinforces the convoluted section 30' and limits or prevents axial lengthening while still allowing the bellows 14' to be flexible.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure.

What is claimed is:

1. A bellows comprising;

a flexible duct including convolutions extending between a first end and a second end, made of a nano-grained aluminum alloy having a grain size less than about 0.5 micrometers (19.7 microinches), wherein the nano-grained aluminum alloy comprises at least about 0.3 wt % of nitrogen, about 88.7-98.7 atomic % of aluminum, about 4-10 atomic % of magnesium, about 6-14 atomic % of one or more additional metals selected from a group consisting of zinc, copper, cobalt, zirconium, and nickel; wherein said nano-grained aluminum bellows is one of a spring and a dampener.

2. The bellows as recited in claim 1, further comprising a woven wire sleeve surrounding the convolutions.

3. The bellows as recited in claim 1, further comprising an engine in fluid communication with the flexible duct.

4. The bellows as recited in claim 3, wherein the engine is a rocket engine.

5. A rocket engine system comprising;

a fuel tank;

an oxidizer tank;

an engine;

the bellows of claim 1 connecting said fuel tank, said oxidizer tank, and said engine.

6. A suspension element comprising the nano-grained bellows of claim 1.

7. A flexible hose comprising the nano-grained bellows of claim 1.

* * * * *